US007055980B2

(12) United States Patent
Wu

(10) Patent No.: US 7,055,980 B2
(45) Date of Patent: Jun. 6, 2006

(54) DECORATIVE TREE LAMP

(76) Inventor: Jeng-Shyong Wu, No. 14, Alley 1, Lane 326, Shyr-Piin Road, Hsin-Chu City (TW)

( * ) Notice: Subject to any disclaimer, the term of this patent is extended or adjusted under 35 U.S.C. 154(b) by 183 days.

(21) Appl. No.: 10/677,914

(22) Filed: Oct. 2, 2003

(65) Prior Publication Data

US 2005/0024871 A1 Feb. 3, 2005

(30) Foreign Application Priority Data

Mar. 11, 2003 (CN) ..... 03 2 38503

(51) Int. Cl.
*F21S 6/00* (2006.01)

(52) U.S. Cl. ..... 362/123; 362/252; 362/249

(58) Field of Classification Search ..... 362/122, 362/123, 227, 234, 253, 249, 250, 252, 370, 362/391, 418, 431, 441, 449, 450, 457, 458, 362/806–808, 124, 800, 812; 428/9, 11, 428/20; 211/196, 205

See application file for complete search history.

(56) References Cited

U.S. PATENT DOCUMENTS 3,594,260 A * 7/1971 Dieffenbach ..... 428/20
3,970,834 A * 7/1976 Smith ..... 362/123
4,140,823 A * 2/1979 Weskamp ..... 428/9
4,161,768 A * 7/1979 Gauthier et al. ..... 362/123
4,273,814 A * 6/1981 Koehler ..... 428/8
4,343,842 A * 8/1982 Chase ..... 428/8
4,496,615 A * 1/1985 Huang ..... 428/9
4,789,570 A * 12/1988 Maddock ..... 428/8
5,455,750 A * 10/1995 Davis et al. ..... 362/123
5,560,975 A * 10/1996 Casper ..... 428/99
5,855,705 A * 1/1999 Gauthier ..... 156/61
5,908,238 A * 6/1999 Huang ..... 362/391
6,116,563 A * 9/2000 Tsai ..... 248/512
6,155,697 A * 12/2000 Ahroni ..... 362/252
6,794,825 B1 * 9/2004 Kao ..... 315/185 R

* cited by examiner

*Primary Examiner*—Stephen Husar
*Assistant Examiner*—Hargobind S. Sawhney
(74) *Attorney, Agent, or Firm*—McGlew and Tuttle, P.C.

(57) ABSTRACT

A decorative tree lamp includes a long trunk composed of many short pipes. The height of the tree lamp can be adjusted based on the number of the short pipes used. At least one of the short pipes that form the long trunk is provided with one or more connecting rings to connect with many branches. A base frame is used as a supporting surface and has a center axial receiving part to support the long trunk so that it stands up right and straight. Multiple branches connect one end with the connecting ring on the short pipe and use the connecting ring as the base point. The other end of the branch extends away from the center of the trunk to be able to stretch out to form a tree shape and to also be able to be folded up to reduce the volume. One of single or multiple sets of light strings are provided, composed of many lamp bulbs, lamp holders, electrical conductors and receptacles. A fixing device is used to fix the light strings on the branches to establish tree light strings.

21 Claims, 9 Drawing Sheets

DECORATIVE TREE LAMP

FIELD OF THE INVENTION

The invention relates to a decorative tree with included lights forming a decorative tree lamp.

BACKGROUND OF THE INVENTION

A conventional lamp light string set providing a Christmas light string includes a lamp bulb, lamp base, lamp holder, multiple electrical conductors, and receptacles or a flasher control. The electrical conductors can be single or double or more than two wound into an electrical circuit. The distributed conductors can be formed in one, two or more than two electrical conductors, such as shown in FIG. 4 of U.S. Pat. No. 4,241,387 and the attached FIGS. 1 and 2 (the prior art) in this case. In general, such electrical conductors are wound on trees. This can be troublesome and monotonous. Further, such work must be repeated over several years. The present invention provides an improvement that addresses the defects of the conventional products. The present invention also involves the use of artificial tree trunks and tree branches to provide decorative light strings along with the electrical connectors wound on the trees, so that the decorative light strings and branches of trees are to form a shape so as to obtain a decorative effect.

SUMMARY OF THE INVENTION

The present invention allows a conventional Christmas light string to be easily transported and presents an improvement in the defects of the conventional products. The present invention relates to the use of a kind of decorative tree lamp, including a long trunk to be composed of many short pipes, the height of tree lamp can be adjusted by the use of a number of short pipes. These short pipes on the long trunk are provided with one or more connecting rings to connect with many branches. A base frame is used as a supporting surface to erect the base frame and has a center axle to support the long trunk so as to stand up right straight. Multiple branches connect one end with the connecting ring on the short pipe so as to use the connecting ring as the base point. The other end of the branch is used as the center of the trunk to be able to stretch out to form a tree shape. This may also be folded up to reduce the volume. Single or multiple sets of light strings, composed of many lamp bulbs, lamp holders, electrical conductors and receptacles are used with a fixing device to fix them on the branches to establish tree light strings.

The present invention relates to such a decorative tree lamp with the branch being a single pillar as well as extending to sub-branches.

The present invention relates to such a decorative tree lamp with the branch being provided as multiple pillars twisting and extending to sub-branches.

The present invention relates to the decorative tree lamp with the light string connected as a single electrical conductor with lamp holder and lamp bulb.

The present invention relates to the decorative tree lamp and the light string provided with a single electrical conductor twisted and connected with a non-electrical connector, and a decorative golden scallions attached to the non-electrical connector.

The present invention relates to the decorative tree lamp and the light string with multiple electrical conductors connected with a lamp holder and lamp bulb as well as twisting and winding with resepvct to each other.

The present invention relates to the decorative tree lamp and the use of a fixing device in the form of a C-clip to clip and fix the electrical conductor and branches.

The present invention relates to the decorative tree lamp and the use of the fixing device to twist and fix the electrical conductor on the branches.

The present invention relates to the decorative tree lamp and the use of the fixing device including a non-electrical connector to twist and wind the electrical conductor and to fix same on the branches. Further a decorative golden scallions can be attached to the non-electrical connector.

The present invention relates to the decorative tree lamp and to the use of the fixing device of a movable clip to tightly fix and fasten the electrical conductor and branches.

The present invention relates to the decorative tree lamp and to the use of a movable clip having two concave arms with a hollow trough toward an inner side. There is a slice between the arms, the end of one arm has a hole, and the end of the other arm has a hook flange, to use the slice as a curve line to fold up toward the inner side, to clip the electrical conductor and branch to be located at hollow trough. The upside hook flange goes through to the hole on the other end, and the flange fastens tightly on the hole edge preventing it from loosing.

The present invention relates to the decorative tree lamp and the fixing device used to fix single or multiple electrical conductors and single or multiple pillars together so as not to loose.

The present invention relates to the decorative tree lamp and the lamp holder of the light string being cylinder, said lamp holder is connected with electrical conductor. After the fixing device is to fix with electrical conductor, the decorative tree lamp can be suspended freely in the air as needed.

The present invention relates to the decorative tree lamp and the fixing device used to fix the cover connecting the branch tail, and the cover hole fixes tightly on the lamp holder.

The present invention relates to the decorative tree lamp and to use the fixed cover with one end having a hole. The branch tail goes through the hole to connect and fix it tightly. The other end has a cover hole, and its edge has a gap, when it fits into the lamp holder, the elasticity is to fit the lamp holder tightly so as not to fall off easily.

The present invention relates to the decorative tree lamp and the surrounding edge of the circumference of the lamp holder having a hook. It is able to individually or simultaneously hook the electrical conductor, non-electrical connector or branch, to let lamp holder and lamp bulb be fixed on the position or direction.

The present invention relates to the decorative tree lamp and to the use of a single circuit loop or many sets of single circuit loops of light strings to connect the power in receptacle individually.

The present invention relates to the decorative tree lamp and to the use of a single circuit loop or many sets of single circuit loops of light strings to connect the power in receptacle simultaneously or individually.

The present invention relates to the decorative tree lamp and the light string having an attached protection device, transformer or functional control device to increase the decoration functionality.

The present invention relates to the decorative tree lamp and the branch being able to bending metal threads.

The present invention relates to decorative tree lamp and particularly to a kind of decorative lamp tree including a long trunk to be composed of many short pipes. The height of the tree lamp can be adjustable by the number of the short pipes. The short pipes have one or many connecting rings to connect with branches. A base frame has many supporting frames and the center of the frames used as axle to support long trunk to stand up right straight; multiple branches and base part of the branch to form a round shape and there is a hole on the central part between two vanes, to use the pin from one end of the vane going through its hole, then going through the hole of the base part of branch to another hole of the vane. The pin is fixed and the pin is used as an axle to make branches stretch out to form a tree shape and also fold up to reduce the volume. A single set or multiple sets of light strings are provided composed of many lamp bulbs, lamp holders, electrical conductors and receptacles, to use the fixing device to fix them on the branches to establish tree light strings.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
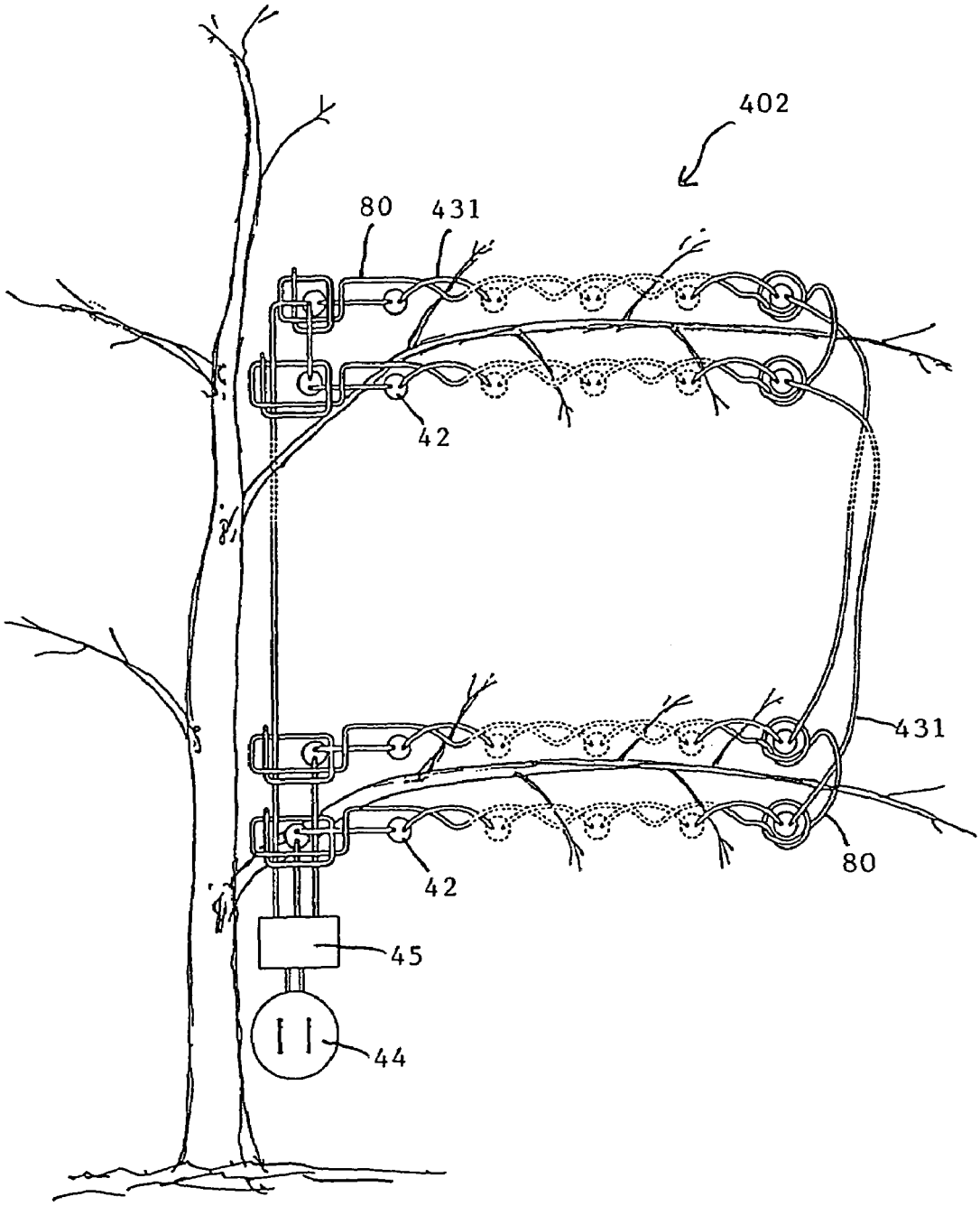
FIG. 1 (PRIOR ART)
FIG. 1 is a perspective view of the decorative tree lamp of the prior art.

Referring to the drawings in particular, for the convenience of the description, the same parts are designated by the same number in the drawings.

Referring to FIG. 1, a conventional light string is shown in a perspective view. The conventional light string includes an electrical conductor used to connect lamp holder 42 and lamp bulb 41. The structure is formed by using serial or serial-parallel connections. The single electrical conductor 431 or many electrical conductors are used to form a single loop or a multiple loop 402. The loop 402 is attached with non-electrical connector 80. The receptacle 44 connects with a light string and a power supply. Between the receptacle 44 and the lamp holder 42, a protected device, a transformer or a functional control device 45 are attached. The lamp holder attached with a hook trough is used to hang the electrical conductor 431 and non-electrical connector 80, then to hang on the tree to establish decorative tree lamp.

Figure 2:
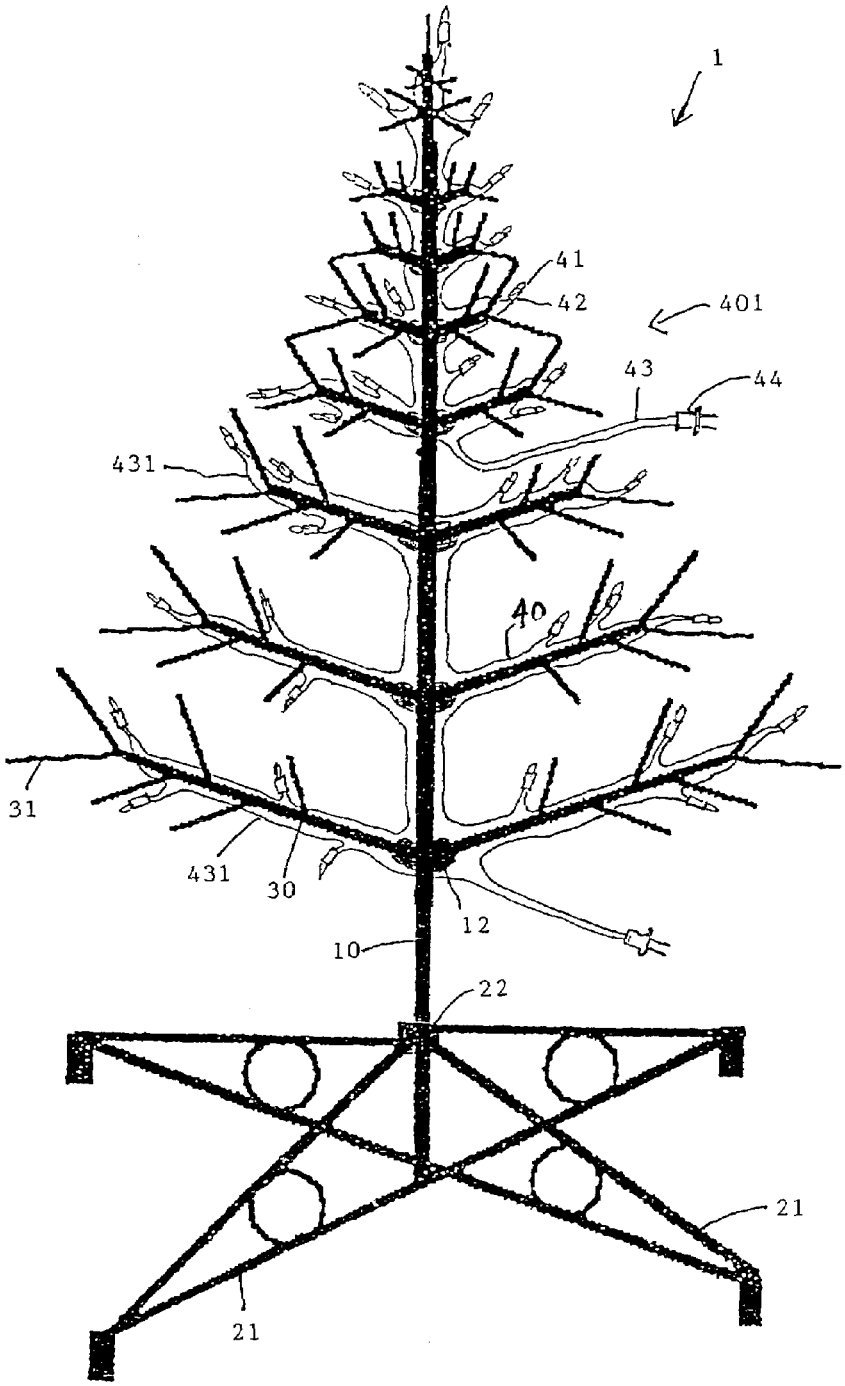
FIG. 2 is a perspective view with 3-dimensional aspects, showing the practical structure of the decorative tree lamp of the present invention.

FIG. 2 is a perspective view with 3-dimensional aspects showing the practical structure of the decorative tree lamp of the present invention. FIG. 2 shows the structure of the decorative tree lamp, which includes a long trunk 10 formed by many nodes of short pipes 11 connected. The number of short pipes 11 determines the length of the tree lamp. Each short pipe 11 has one or many connecting rings 12 connected with branches 30. A base frame 20 has many supporting frames 21. At the center of these frames 21 there is an axis 22 to support the long trunk 10 standing up vertically. One end of the multiple branches 30 connects with the connecting ring 12 on the short pipe 11. This construction uses the connecting rings 12 as the base point. The other end of branches 30 is angled relative to the axis of the long trunk 10, to extend to the designed tree shape. These can be folded up to reduce the volume. Single or multiple sets of light strings 40 are provided consisting of many lamp bulbs 41, lamp holders 42, electrical conductors 43 and receptacles 44. The fixing device 60 is used to fix each light string on the branches to establish the tree lamp.

Figures 3, 3A:
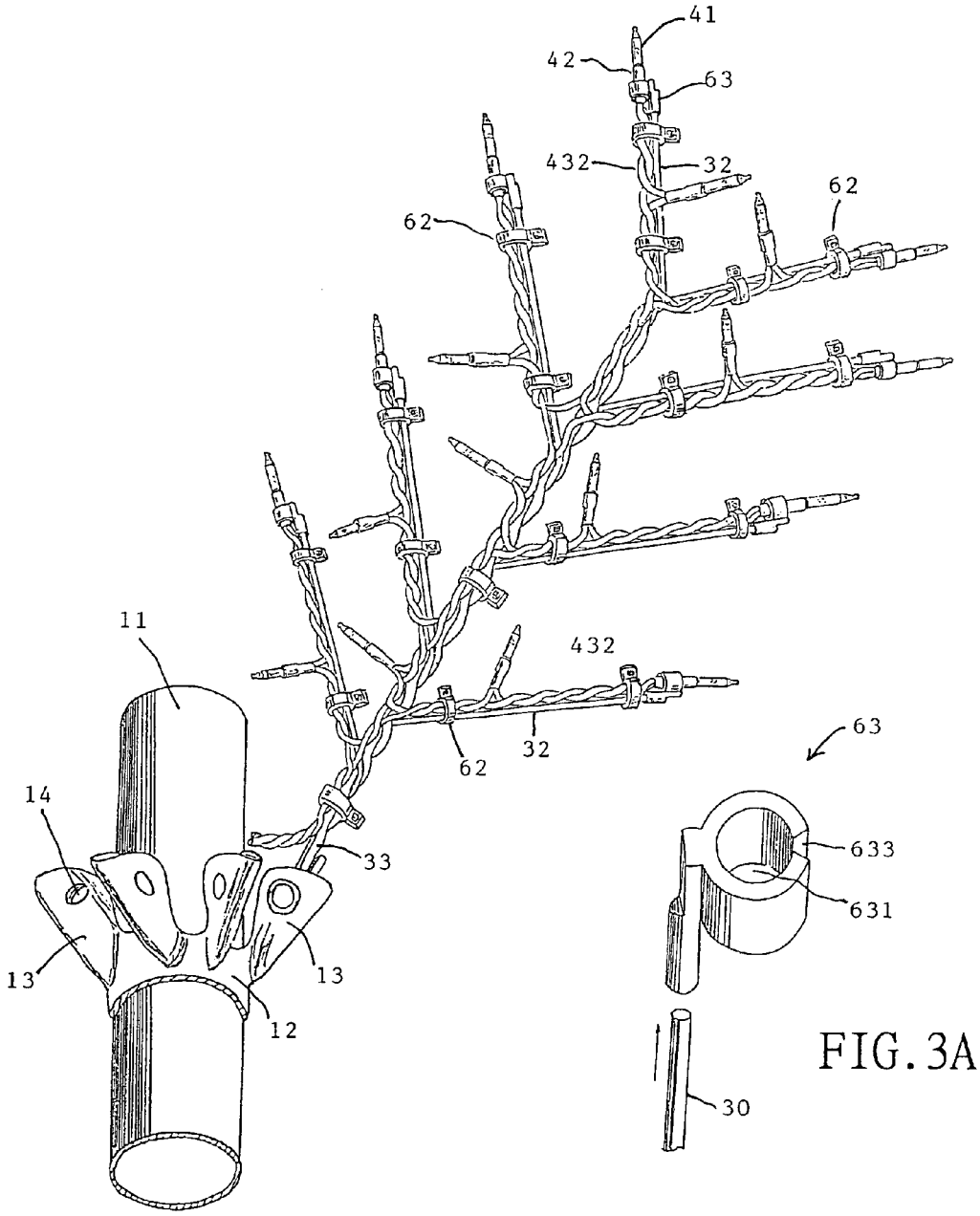
FIG. 3 is a perspective view showing the structure of long trunk and light string of the decorative tree lamp of the present invention.
FIG. 3A is a perspective view showing the structure of the fixing cover on the single or multiple branches of the decorative tree lamp of the present invention.

FIG. 3 is a perspective view showing the structure of long trunk and light string of the decorative tree lamp of the present invention. The long trunk 10 has many connected nodes of the short pipes 11 with a connecting ring 12 attached on the short pipe 11. A vane 13 of the ring 12 has a hole 14 equipped on connecting ring 12. Branches having many pillars 33 are used and have a base part to form a round shape with the center having a hole. The branch is put on the center between the sides of vane 13 of connecting ring 12. One end of a pin goes through the hole from the hole on its vane, then goes through the hole on the branch and fixes it. This pin is used as an axis. A single or many sets of light string are used on the branches. The light string includes many lamp bulbs 42, lamp holders 42, one or more electrical conductor 432 and a receptacle 44. The fixing device is used to fix the light string on the branches. The fixing device can include a moveable clip 62 to fix the light string 40 on the tree lamp to establish the decorative tree lamp. Further, the branches 30 can also use a single pillar 32 as part of the fixing device.

FIG. 3A is a perspective view showing another version of the fixing device having the structure of a fixed cover 63 in the single or multiple branches of the decorative tree lamp of the present invention. This fixed cover 63 sticks into branch 30 to fix the fixed cover 63 on the branch 30. The fixed cover 63 has cover hole 631 and the gap 633. The lamp holder 42 via the gap 633 can put into the cover hole 631 so as to fix the lamp holder 42.

Figure 4:
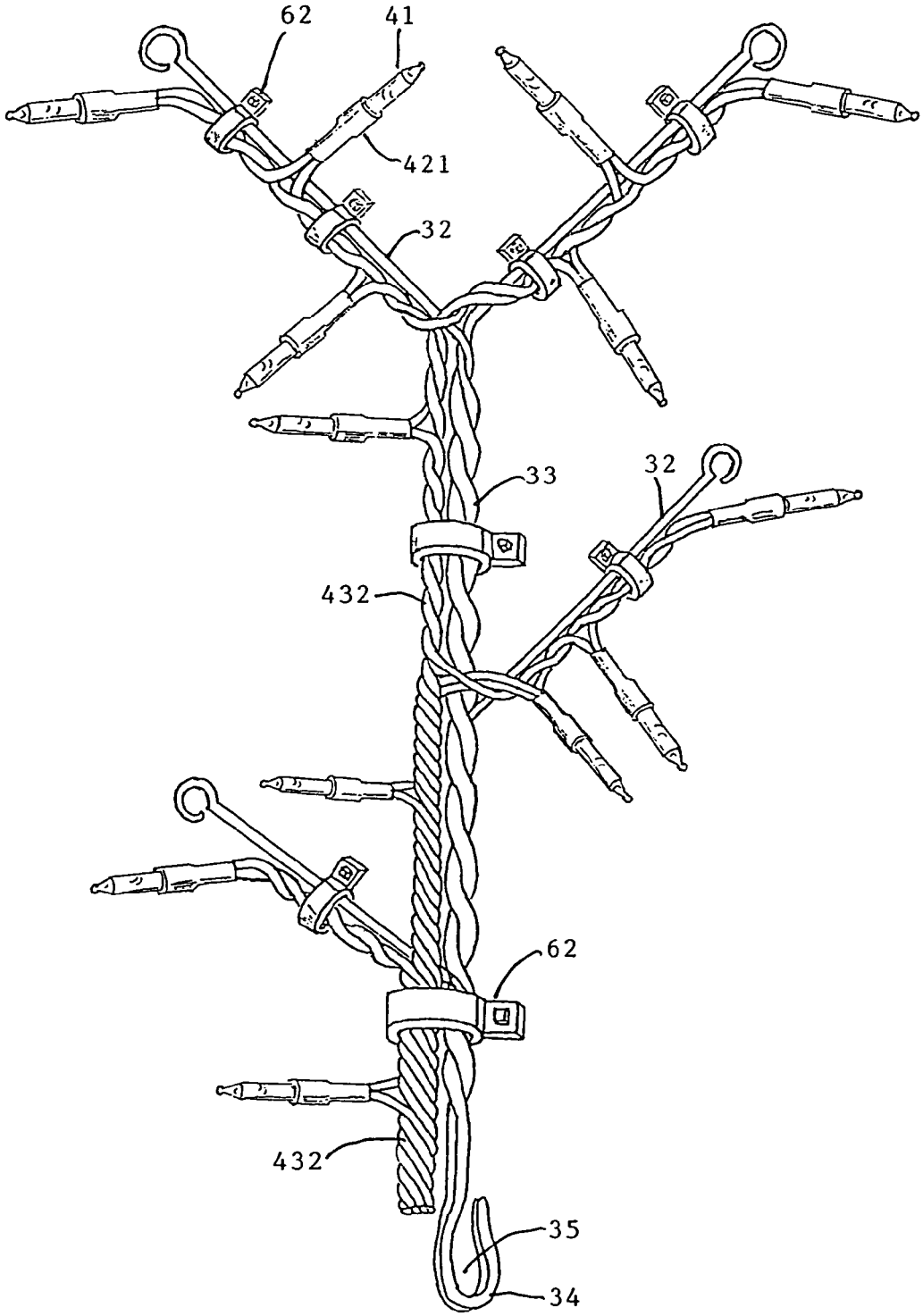
FIG. 4 is a perspective view of single or multiple branches of a further embodiment of the decorative tree lamp of the present invention.

FIG. 4 is a perspective view of single or multiple branches of a further embodiment of the decorative tree lamp of the present invention. The base part 34 of many pillars 33 twists in a round shape. A center is provided with a hole 35 to be put between dual vanes of the connecting ring. One end of a pin goes through the hole 35 on the vane 13, and goes through the hole on the branch 30 and the pin is fixed. The pin is used as an axis. The other end of the branch 30 uses long trunk 10 as an axis to extend to the designed tree shape and also be able to fold up so as to reduce the volume.

Figure 5A:
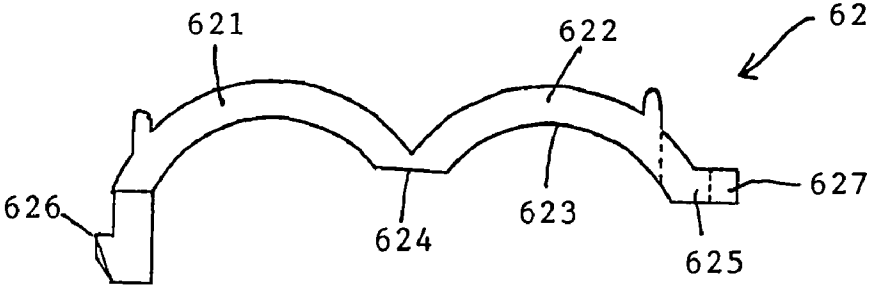
FIG. 5A is a side view of the fixing device of the decorative tree lamp of the present invention.
Figure 5B:
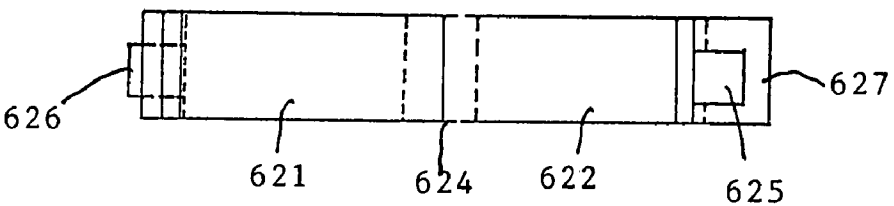
FIG. 5B is an interior view of the fixing device of the decorative tree lamp of the present invention.
Figure 5:
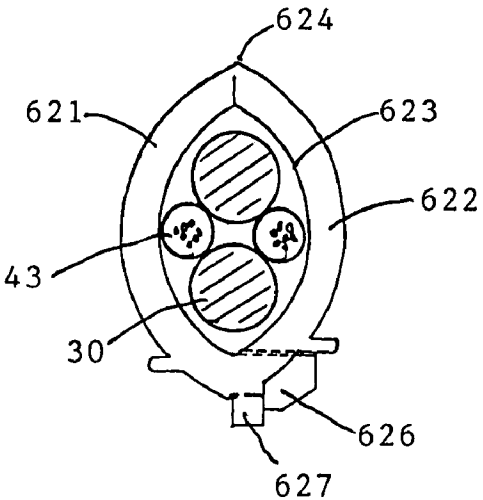
FIG. 5 is a perspective view showing the connection afforded by the fixing device of the decorative tree lamp of the present invention.

FIG. 5 is a perspective view showing the connection style of fixing device of the decorative tree lamp of the present invention. The movable clip 62 is used to fasten and fix tightly the electrical conductor 43 and branches 30. The movable clip 62 has an inner side of a concave trough shape and has two arms 621, 622. A slice 624 is provided between the two arms 621 and 622. The end of one arm has a hole 625, and the other end has an upside hook flange 626. The slice is used as a curve line allowing the two arms to be folded up toward features enclosed at the inner side. The electrical conductor and branch are clipped at the concave trough. The upside hook flange 626 goes through to the other end of the hole, and the flange is fastened tightly on the hole rim 627 so as not to loose.

FIG. 5A is a side view of the fixing device of the decorative tree lamp of the present invention. The movable clip 62 of the fixing device is shown in FIG. 5 fixed and connected. FIG. 5B shows a side view showing the interior.

Figure 6:
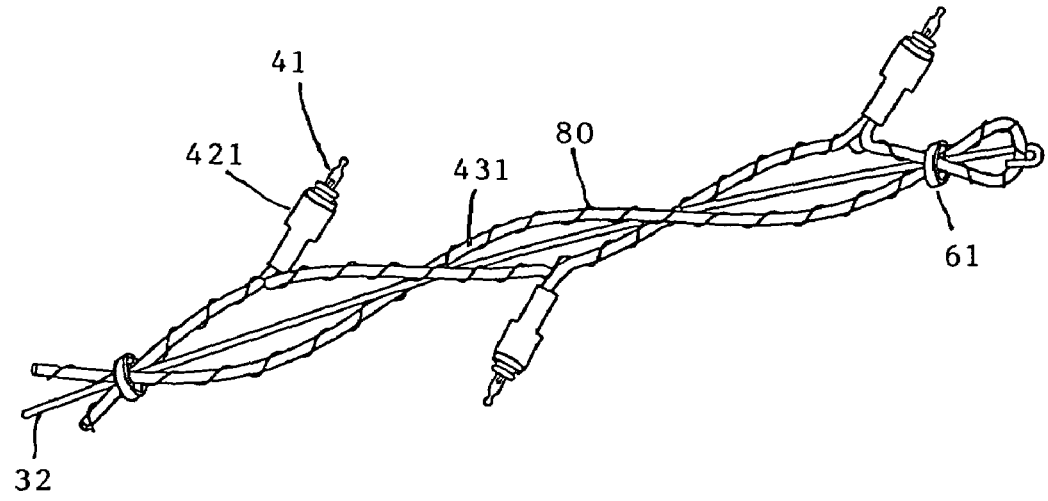
FIG. 6 is a perspective view showing the use of branches of the decorative tree lamp of the present invention.
Figure 6:
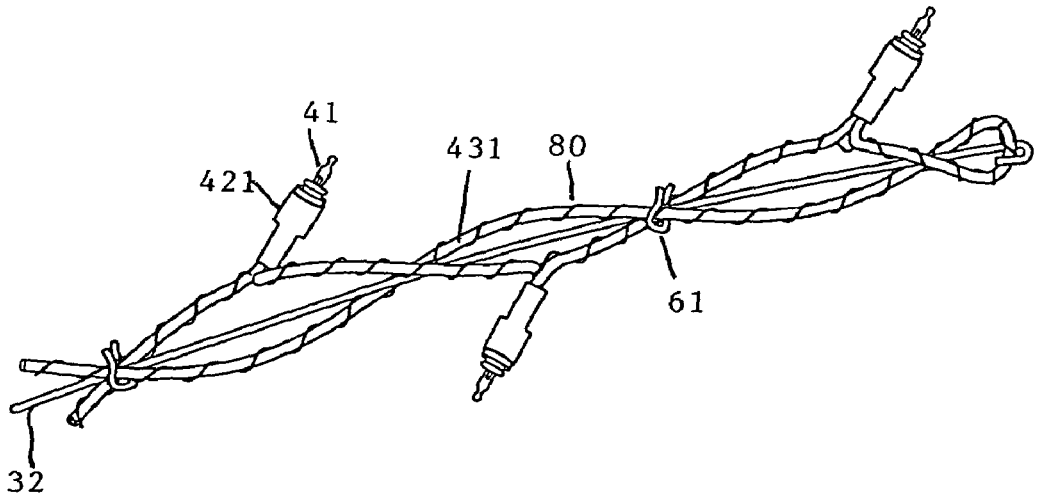

FIG. 6 is a perspective view showing the use of branches of the decorative tree lamp of the present invention. The light string is composed of single electrical conductor 431 to connect with lamp holder 421 and lamp bulb 41. The single electrical conductor 431 and non-electrical connector 80 are twisted and wound to form such structure. The L-clip 61 is used to clip and fix the electrical conductor and branches tightly.

Figure 7:
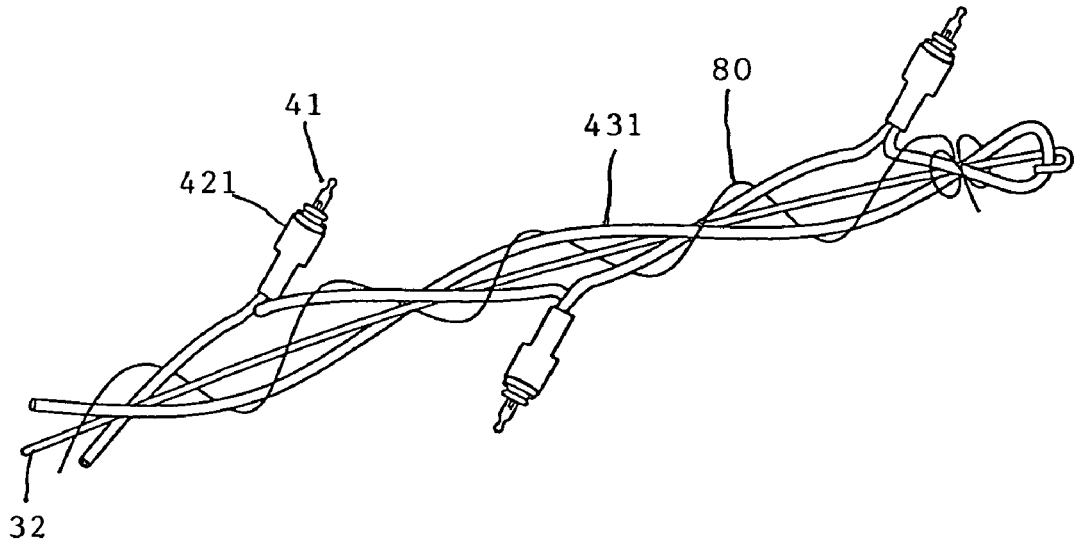
FIG. 7 is a perspective view showing the use of branches and other decorations of the decorative tree lamp of the present invention.
Figure 7:
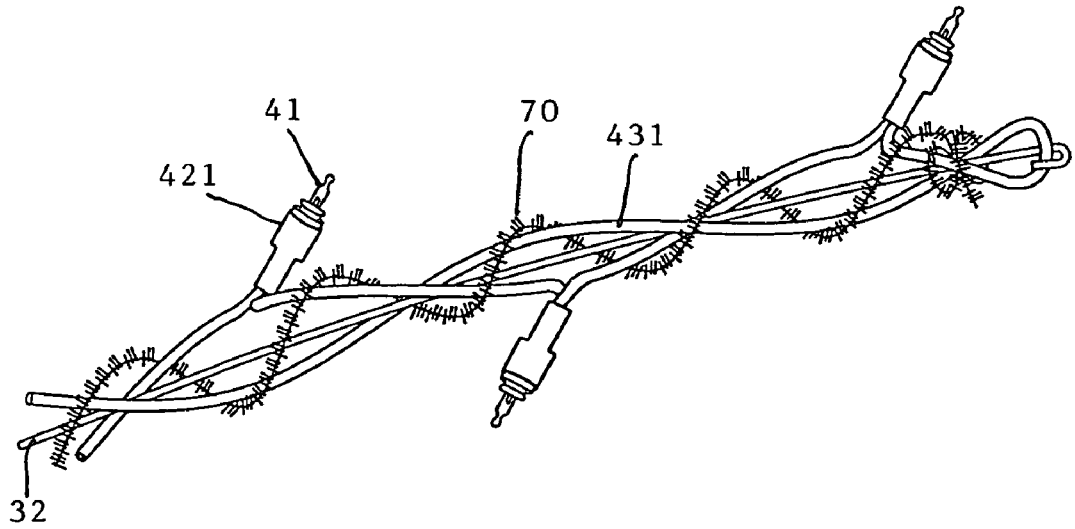

FIG. 7 is a perspective view showing the use of branches of the decorative tree lamp of the present invention. The structure is identical with that of in FIG. 6, but the decorative golden scallions 70 attached to the non-electrical connector to increase decoration effect.

Figure 8:
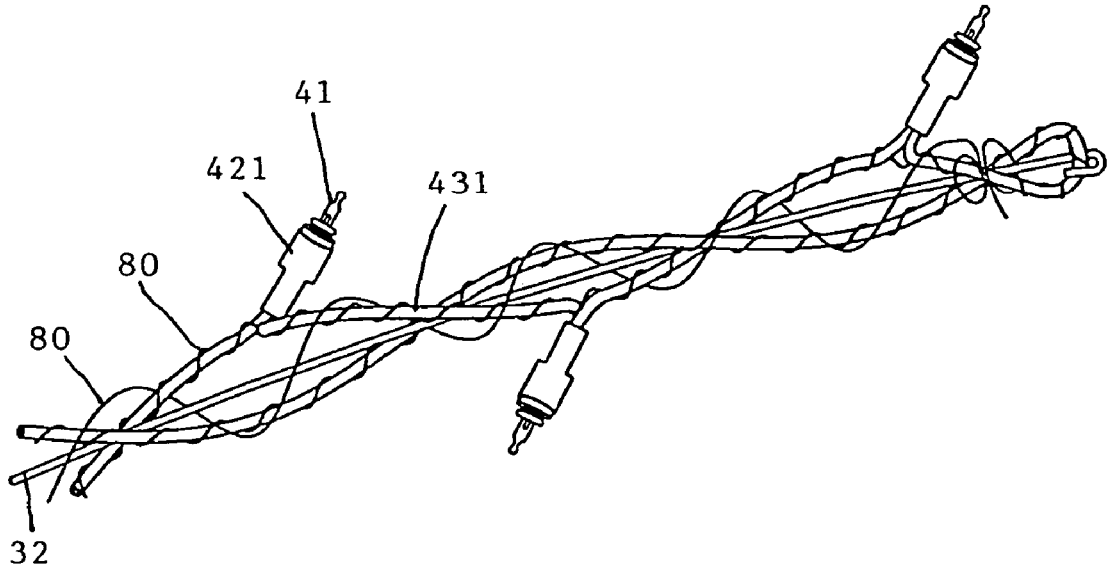
FIG. 8 is a perspective view of the preferred and further embodiment showing the use of branches and other decorations of the decorative tree lamp of the present invention.
Figure 8:
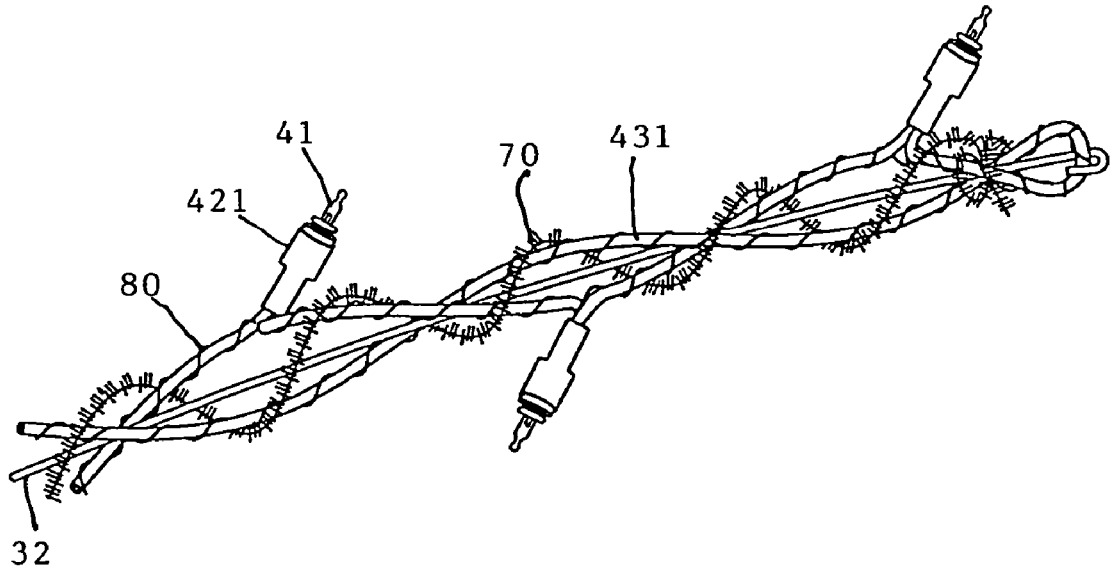

FIG. 8 is a perspective view of the preferred and further embodiment showing the use of branches and other decorations of the decorative tree lamp of the present invention. Its structure is identical with those of in FIG. 6 and FIG. 7.

Figure 9:
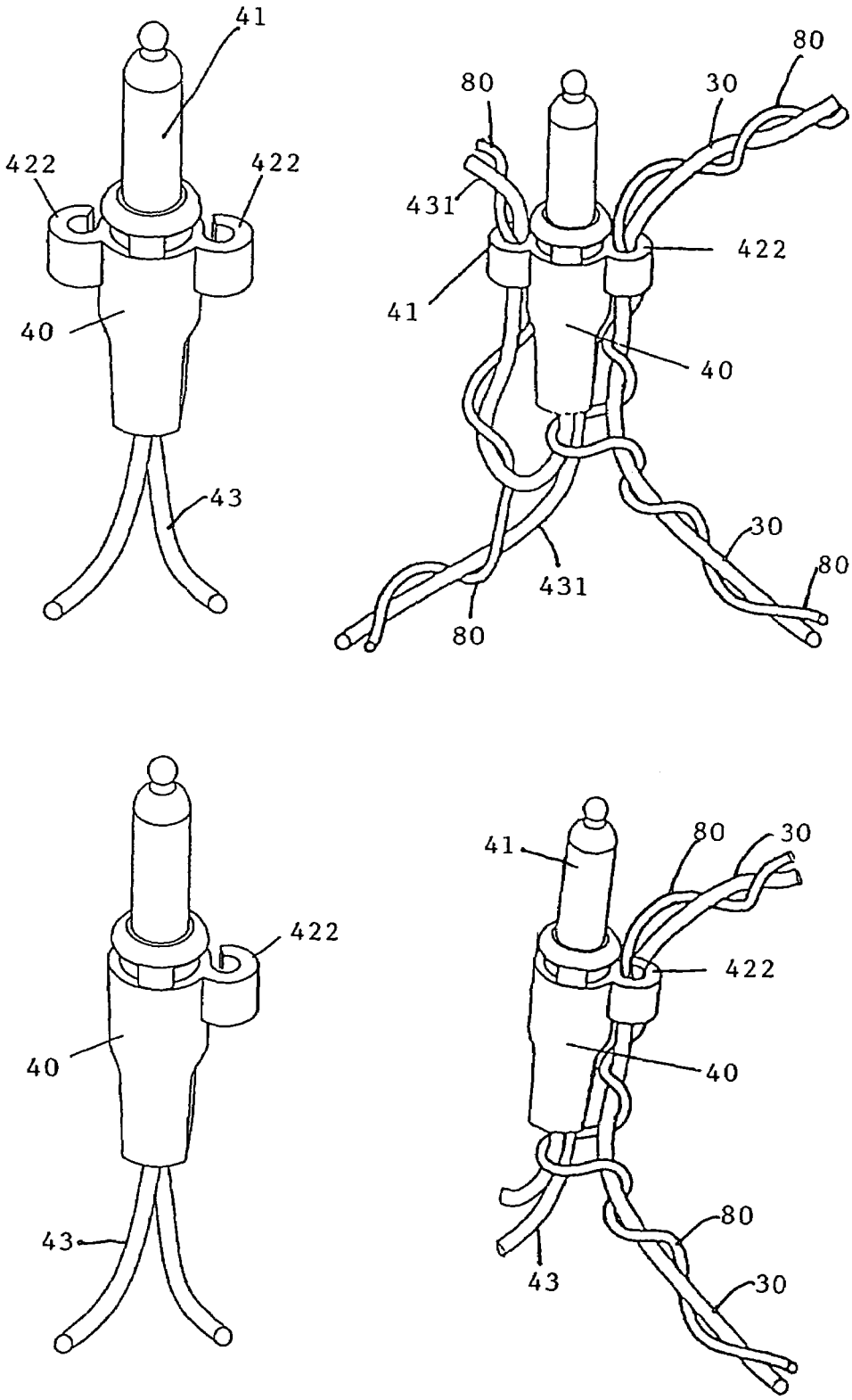
FIG. 9 is a perspective view showing the use of lamp holder and its twisted and wound wires of the decorative tree lamp of the present invention.

FIG. 9 is a perspective view showing the use of lamp holder and associated twisted and wound wires of the decorative tree lamp of the present invention. The twisted and wound wires are in a style in which they surround and edge of the circumference of the lamp holder 40 having hook trough 422. The hook trough 422 is able to hook the electrical conductor 43, non-electrical connector 80 or branches 30 individually or simultaneously to make lamp holder 40 and lamp bulb 41 be fixed on the right position or direction.

From the foregoing it will be appreciated that although specific embodiments of the invention have been described herein for purposed of illustration, various modifications and improvements thereon will become readily apparent to those skilled in the art. Accordingly, the appended claims are to be construed broadly and in a manner consistent with the spirit and scope of the invention described herein.

While specific embodiments of the invention have been shown and described in detail to illustrate the application of the principles of the invention, it will be understood that the invention may be embodied otherwise without departing from such principles.

The invention claimed is:

1. A decorative tree lamp, comprising:

a long trunk composed of a plurality of short pipes, a height of the tree lamp being adjustable based on the inclusion or non incision of a number of said short pipes;

a connecting ring disposed on at least one of said short pipes providing branch receiving vanes receiving a branch therein;

a base frame having a center support for supporting said long trunk to stand up right straight on supporting surfaces to maintain the base frame erect;

multiple branches connected at one end with a respective receiving vane of said connecting ring to use the connecting ring as a base point, each of said branches having at least one tail end stretching out so said branches and said long trunk form a tree shape and are also able to be folded up to reduce the volume thereof;

light strings, each of said light strings comprising a plurality of lamp bulbs, a plurality of lamp holders, a plurality of electrical conductors and being associated with at least one receptacle; and a fixing device having one end with a cover attached to one said tail end of one of said branches and having a hole tightly receiving one of said lamp holders to fix one of said light strings on said one of said branches.

2. A decorative tree lamp as claimed in claim 1, wherein at least one of said branches includes a single pillar as well as extending to sub-branches.

3. A decorative tree lamp as claimed in claim 1, wherein at least one of said branches includes multiple pillars twisting and extending to sub-branches.

4. A decorative tree lamp as claimed in claim 1, further comprising a non-electrical connector to twist and wind the electrical conductor and to fix the electrical conductor on the branches, and a decorative golden scallions being attached to the non-electrical connector.

5. A decorative tree lamp as claimed in claim 1, wherein at least one of said light strings comprises multiple electrical conductors connected with one or more of said lamp holders and lamp bulbs as well as twisting and winding one or more of said lamp holders and lamp bulbs in position relative to one of said branches.

6. A decorative tree lamp as claimed in claim 1, wherein said fixing device includes a C-clip to clip and fix the electrical conductor and branches together.

7. A decorative tree lamp as claimed in claim 1, wherein the fixing device is twisted and fixed by the electrical conductor on a respective one of said branches.

8. A decorative tree lamp as claimed in claim 1, wherein said fixing device includes a non-electrical connector twisting and winding one or more of said electrical conductors to said one of said branches.

9. A decorative tree lamp as claimed in claim 1, wherein the fixing device includes a movable clip fixing and fastening one or more of said electrical conductors tightly to one of said branches.

10. A decorative tree lamp as claimed in claim 9, wherein said movable clip includes two concave arms with a hollow trough toward an inner side and a slice between the arms, the end of one arm having a hole, and the end of the other arm having a hook flange, whereby the slice is used as a curve line to fold up the arms and to clip the electrical conductor and branch to be located at hollow trough, the upside hook flange extending through the hole on the other end, and said hook flange being fastened tightly through the hole on an adjacent rim to prevent the clip from loosening.

11. A decorative tree lamp as claimed in claim 1, wherein at least one of said lamp holders is cylindrical and is connected with one of said electrical conductors, after the fixing device being is fixed with said electrical conductor, whereby the decorative tree lamp is suspended freely.

12. A decorative tree lamp as claimed in claim 1, wherein said hole of said fixing device is defined by a fixing device has a part defining said hole and having a gap, said part defining said hole having sufficient elasticity to fit the lamp holder tightly so as not to fall off.

13. A decorative tree lamp as claimed in claim 12, wherein a circumference of at least one of said lamp holders has the surrounding edge with a hook, able to individually or simultaneously hook the electrical conductor, non-electrical connector or branch, to fix said at least one of said lamp holder in a position or direction.

14. A decorative tree lamp as claimed in claim 1, wherein said light strings comprise a single circuit loop or plural sets of single circuit loops to connect the power from said receptacle simultaneously or individually.

15. A decorative tree lamp as claimed in claim 1, wherein the single circuit loop or many sets of single circuit loop of light string being used to connect the power in receptacle simultaneously or individually.

16. A decorative tree lamp as claimed in claim 1, wherein at least one of said light strings has an attached protection device, transformer or functional control device to increase the decorative illumination functionality.

17. A decorative tree lamp as claimed in claim 1, wherein at least one of said branches comprises a metal wire able to be bent.

18. A decorative tree lamp, comprising:

a long trunk composed of a plurality of short pipes, a height of the tree lamp being adjustable based on the inclusion or non incision of a number of said short pipes;

a connecting ring disposed on at least one of said short pipes providing branch receiving vanes for receiving a branch;

a base frame having a center support for supporting said long trunk to stand up right straight on supporting surfaces to maintain the base frame erect;

multiple branches connected at a base end with a respective receiving vane of said connecting ring to use the connecting ring as a base point, each of said branches having at least one tail end stretching out so said branches and said long trunk form a tree shape and are also able to be folded up to reduce the volume thereof;

light strings, each of said light strings comprising a plurality of lamp bulbs, a plurality of lamp holders, a plurality of electrical conductors and being associated with at least one receptacle; and a fixing device having an end connection part attached to one said tail end of one of said branches holding one of said light strings relative to said one tail end of one of said branches and having an intermediate connection part to fix one of said light strings to said one of said branches at an intermediate location between said base end and said one tail end.

19. A decorative tree lamp as claimed in claim 18, wherein said end connection part has one end with a cover attached to one said tail end of one of said branches and has a hole tightly receiving one of said lamp holders to fix one of said light strings on said one of said branches and said intermediate connection part includes one of a non-electrical connector to twist and wind the electrical conductor and to fix the electrical conductor on the branches, a movable clip fixing and fastening one or more of said electrical conductors tightly to one of said branches and a twisting or connecting of one or more of said electrical conductors tightly to one of said branches.

20. A decorative tree lamp as claimed in claim 18, wherein said end connection part has one end with a cover attached to one said tail end of one of said branches and has a hole tightly receiving one of said lamp holders to fix one of said light strings on said one of said branches and said intermediate connection part includes one of a non-electrical connector to twist and wind the electrical conductor and to fix the electrical conductor on the branches, a movable clip fixing and fastening one or more of said electrical conductors tightly to one of said branches and a twisting or connecting of one or more of said electrical conductors tightly to one of said branches.

21. A decorative tree lamp, comprising:

a long trunk composed of a plurality of short pipes, a height of the tree lamp being adjustable based on the inclusion or non incision of a number of said short pipes;

a connecting ring disposed on at least one of said short pipes providing branch receiving vanes defining a branch receiving support;

a base frame having a center support for supporting said long trunk to stand up right straight on supporting surfaces to maintain the base frame erect;

multiple branches connected at a base end with a respective receiving vane of said connecting ring to use the connecting ring as a base point, said receiving vane supporting a respective one of said branches and distributing forces from said branch to said connecting ring and to said one of said short pipes, each of said branches having at least one tail end stretching out so said branches and said long trunk form a tree shape and are also able to be folded up to reduce the volume thereof;

light strings, each of said light strings comprising a plurality of lamp bulbs, a plurality of lamp holders, a plurality of electrical conductors and being associated with at least one receptacle; and a fixing device having an end connection part attached to one said tail end of one of said branches holding one of said light strings relative to said one tail end of one of said branches and having an intermediate connection part to fix one of said light strings to said one of said branches at an intermediate location between said base end and said one tail end.

* * * * *